US007073597B2

(12) United States Patent
Williams

(10) Patent No.: US 7,073,597 B2
(45) Date of Patent: Jul. 11, 2006

(54) DOWNHOLE DRAW DOWN PUMP AND METHOD

(76) Inventor: Danny T. Williams, 1210 Seabury Ct., Katy, TX (US) 77494

( * ) Notice: Subject to any disclaimer, the term of this patent is extended or adjusted under 35 U.S.C. 154(b) by 33 days.

(21) Appl. No.: 10/659,663

(22) Filed: Sep. 10, 2003

(65) Prior Publication Data

US 2005/0051340 A1 Mar. 10, 2005

(51) Int. Cl.
*E21B 43/18* (2006.01)
*F04F 5/00* (2006.01)

(52) U.S. Cl. ..... 166/372; 166/105; 175/213; 417/172

(58) Field of Classification Search ..... 166/312, 166/99, 167, 369, 370, 372, 105, 168, 169, 166/222; 175/213, 320; 417/172
See application file for complete search history.

(56) References Cited

U.S. PATENT DOCUMENTS

| | | | | | |
|---|---|---|---|---|---|
| 47,793 | A | * | 5/1865 | Brear | 417/172 |
| 1,693,101 | A | * | 11/1928 | Worthington | 417/80 |
| 2,290,141 | A | * | 7/1942 | Burt | 166/312 |
| 2,291,911 | A | * | 8/1942 | McMahon | 417/172 |
| 2,909,127 | A | * | 10/1959 | Bradaska | 417/172 |
| 4,074,799 | A | * | 2/1978 | Hishida et al. | 400/208 |
| 4,135,861 | A | | 1/1979 | Brown et al. | |
| 4,171,016 | A | | 10/1979 | Kempton | |
| 4,183,722 | A | | 1/1980 | Roeder | |
| 4,274,812 | A | | 6/1981 | Elvidge et al. | |
| 4,275,926 | A | * | 6/1981 | Hodges | 299/17 |
| 4,285,638 | A | | 8/1981 | Clark | |
| 4,293,283 | A | | 10/1981 | Roeder | |
| 4,310,288 | A | * | 1/1982 | Erickson | 417/54 |
| 4,453,886 | A | | 6/1984 | Wilson | |
| 4,505,646 | A | * | 3/1985 | Long et al. | 417/172 |
| 4,536,035 | A | * | 8/1985 | Huffman et al. | 299/17 |
| 4,603,735 | A | | 8/1986 | Black | |
| 4,605,069 | A | * | 8/1986 | McClaflin et al. | 166/310 |
| 4,630,691 | A | * | 12/1986 | Hooper | 175/65 |
| 4,664,603 | A | | 5/1987 | Priestly | |
| 4,718,486 | A | | 1/1988 | Black | |
| 4,726,420 | A | | 2/1988 | Weeks | |
| 4,744,730 | A | | 5/1988 | Roeder | |
| 4,790,376 | A | | 12/1988 | Weeks | |
| 4,820,131 | A | | 4/1989 | Johnson | |
| 4,963,073 | A | | 10/1990 | Tash et al. | |
| 5,024,274 | A | | 6/1991 | Schwab, Jr. | |
| 5,033,545 | A | * | 7/1991 | Sudol | 166/312 |
| 5,080,560 | A | | 1/1992 | LeRoy et al. | |
| 5,088,896 | A | | 2/1992 | Nielsen et al. | |
| 5,372,190 | A | | 12/1994 | Coleman | |

(Continued)

*Primary Examiner*—Jennifer H. Gay
(74) *Attorney, Agent, or Firm*—C. Dean Domingue; Robert L. Waddell; Ted A. Anthony

(57) ABSTRACT

An apparatus and method for drawing down a fluid level in a wellbore which has a first tubular disposed within the wellbore so that a wellbore annulus is formed. The apparatus further includes an annular nozzle operatively attached to the first tubular, and wherein the annular nozzle comprises: an annular adapter; and, a suction tube that extends from the annular member into an inner portion of the first tubular. The apparatus further comprises a second tubular concentrically disposed within the first tubular so that a micro annulus is formed therein. The apparatus may further contain a jetting device for delivering an injected medium injected from the micro annulus into the wellbore annulus, and a stabilizer that stabilizes the second tubular within the first tubular.

23 Claims, 6 Drawing Sheets

U.S. PATENT DOCUMENTS 5,374,163 A 12/1994 Jaikaran
5,435,628 A * 7/1995 Montgomery et al. ..... 299/17
5,488,993 A 2/1996 Hershberger
5,707,214 A 1/1998 Schmidt
5,716,006 A 2/1998 Lott
5,743,717 A 4/1998 Schmidt
5,788,464 A 8/1998 Gabelgaard
5,806,599 A 9/1998 Hisaw et al.
6,146,105 A 11/2000 Williams
6,209,641 B1 * 4/2001 Stevenson ..... 166/266
6,354,371 B1 3/2002 O'Blanc
6,382,321 B1 5/2002 Bates et al.
6,450,775 B1 9/2002 Hutchinson et al.
6,511,041 B1 1/2003 Faustinelli
6,543,534 B1 4/2003 Erick
2001/0025651 A1 10/2001 Almeida
2002/0029888 A1 3/2002 Swensen
2002/0070369 A1 6/2002 Faustinelli
2002/0134554 A1 9/2002 Schrenkel et al.
2002/0139525 A1 10/2002 Erick
2004/0104023 A1 * 6/2004 Stark et al. ..... 166/68.5

* cited by examiner

DOWNHOLE DRAW DOWN PUMP AND METHOD

BACKGROUND OF THE INVENTION

This invention relates to a downhole pump. More particularly, but not by way of limitation, this invention relates to a downhole draw down pump used to withdraw fluid from a wellbore and method.

In the production of oil and gas, a well is drilled in order to intersect a hydrocarbon bearing deposit, as is well understood by those of ordinary skill in the art. The well may be of vertical, directional, or horizontal contour. Also, in the production of natural gas, including methane gas, from coal bed seams, a wellbore is drilled through the coal bed seam, and methane is produced via the wellbore.

Water encroachment with these natural gas deposits is a well documented problem. Once water enters the wellbore, production of the hydrocarbons can be severely hampered due to several reasons including the water's hydrostatic pressure effect on the in-situ reservoir pressure. Down hole pumps have been used in the past in order to draw down the water level. However, prior art pumps suffer from several problems that limit the prior art pump's usefulness. This is also true of wellbores drilled through coal beds. For instance, in the production of methane from coal bed seams, a sump is often times drilled that extends past the natural gas deposit. Hence, water can enter into this sump. Water encroachment can continue into the wellbore, and again the water's hydrostatic pressure effect on the in-situ coal seam pressure can cause termination of gas production. As those of ordinary skill will recognize, for efficient production, the water in the sump and wellbore should be withdrawn. Also, rock, debris and formation fines can accumulate within this sump area and operators find it beneficial to withdraw the rock and debris.

Therefore, there is a need for a downhole draw down pump that can be used to withdraw a fluid contained within a wellbore that intersects a natural gas deposit. These, and many other needs, will be met by the invention herein disclosed.

SUMMARY OF THE INVENTION

An apparatus for use in a wellbore is disclosed. The apparatus comprises a first tubular disposed within the wellbore so that a wellbore annulus is formed therein, and wherein the first tubular has a distal end and a proximal end. The apparatus further includes an annular nozzle operatively attached to the distal end of the first tubular, and wherein the annular nozzle comprises: an annular adapter; and, a suction tube that extends from the annular adapater into an inner portion of the first tubular. In one embodiment, the suction tube may be threadedly attached to the annular adapter.

The apparatus further comprises a second tubular concentrically disposed within the first tubular so that a micro annulus is formed therein, and wherein a first end of the second tubular is positioned adjacent the suction tube so that a restricted area is formed within an inner portion of the second tubular.

The apparatus may further contain jet means, disposed within the first tubular, for delivering an injected medium from the micro annulus into the wellbore annulus. Also, the apparatus may include stabilizer means, disposed about the second tubular, for stabilizing the second tubular within the first tubular. The apparatus may further contain an inner tubing restriction sleeve disposed within the inner portion of the second tubular, and wherein the inner tubing restriction sleeve receives the suction tube.

Additionally, the apparatus may include means, located at the surface, for injecting the injection medium into the micro annulus. The injection medium may be selected from the group consisting of gas, air, or fluid.

In one of the preferred embodiments, the wellbore intersects and extends past a coal bed methane gas seam so that a sump portion of the wellbore is formed. Also, in one of the preferred embodiments, the apparatus is placed below the coal bed methane gas seam in the sump portion. In another embodiment, the apparatus may be placed within a wellbore that intersects subterranean hydrocarbon reservoirs.

The invention also discloses a method of drawing down a fluid column from a wellbore, and wherein the wellbore intersects a natural gas deposit. The method comprises providing a first tubular within the wellbore so that a wellbore annulus is formed therein, the first tubing member having an annular nozzle at a first end. The annular nozzle contains an annular adapter that is connected to a suction tube, and wherein the suction tube extends into an inner portion of the first tubular.

The method includes disposing a second tubular concentrically within the first tubular so that a micro annulus is formed, and wherein a first end of the second tubular is positioned about the suction tube. A medium is injected into the micro annulus which in turn causes a zone of low pressure within the suction tube. Next, the fluid contained within the welbore annulus are suctioned into the suction tube. The fluid is exited from the suction tube into an inner portion of the second tubular, and wherein the fluid is mixed with the medium in the inner portion of the second tubular. The fluids, solids and medium are then discharged at the surface.

In one embodiment, the method may further comprise injecting the medium into the wellbore annulus and mixing the medium with the fluid within the wellbore annulus. Then, the medium and fluid is forced into the suction tube.

The method may also include lowering the level of the fluid within the wellbore annulus, and flowing the natural gas into the wellbore annulus once the fluid level reaches a predetermined level. The natural gas in the wellbore annulus can then be produced to a surface collection facility.

In another preferred embodiment, a portion of the medium is jetted from the micro annulus into the wellbore annulus, and the medium portion is mixed with the fluid within the wellbore annulus. The medium and fluid is forced into the suction tube. The level of the fluid within the wellbore annulus is lowered. The injection of the medium into the micro annulus is terminated once the fluid level reaches a predetermined level. The natural gas can then be produced into the wellbore annulus which in turn will be produced to a surface collection facility.

In one of the preferred embodiments, the wellbore contains a sump area below the level of the natural gas deposit and wherein the suction member is positioned within the sump area. Additionally, the natural gas deposit may be a coal bed methane seam, or alternately, a subterranean hydrocarbon reservoir.

An advantage of the present invention is the novel annular nozzle. Another advantage of the present invention includes the apparatus herein disclosed has no moving parts. Another advantage is that the apparatus and method will draw down fluid levels within a wellbore. Another advantage is that the apparatus and method will allow depletion of low pressure wells, or wells that have ceased production due to insufficient in-situ pressure, and/or pressure depletion.

Yet another advantage is that the apparatus and method provides for the suctioning of fluids and solids. Another advantage is it can be run in vertical, directional, or horizontal wellbores. Another advantage is a wide range of suction discharge can be implemented by varying medium injection rates. Another advantage is that the device can suction from the wellbore both fluids as well as solids.

A feature of the present invention is that the annular nozzle provides for an annular flow area for the power fluid. Another feature of the invention is that the annular nozzle includes an annular adapter and suction tube and wherein the annular adapter is attached to a tubular member, with the annular adapter extending to the suction tube. Another feature is use of a restriction adapter sleeve disposed on an inner portion of a second tubular member. Yet another feature is that the restriction sleeve may be retrievable.

Another feature includes use of jets that are placed within the outer tubular member to deliver an injection medium to the wellbore annulus. Yet another feature is that the jets can be placed in various positions and directed to aid in evacuating the wellbore annulus. Still yet another feature is that the suction tube may contain a check valve to prevent a back flow of fluid and/or solids.

DETAILED DESCRIPTION OF THE PREFERRED EMBODIMENTS

Figure 1:
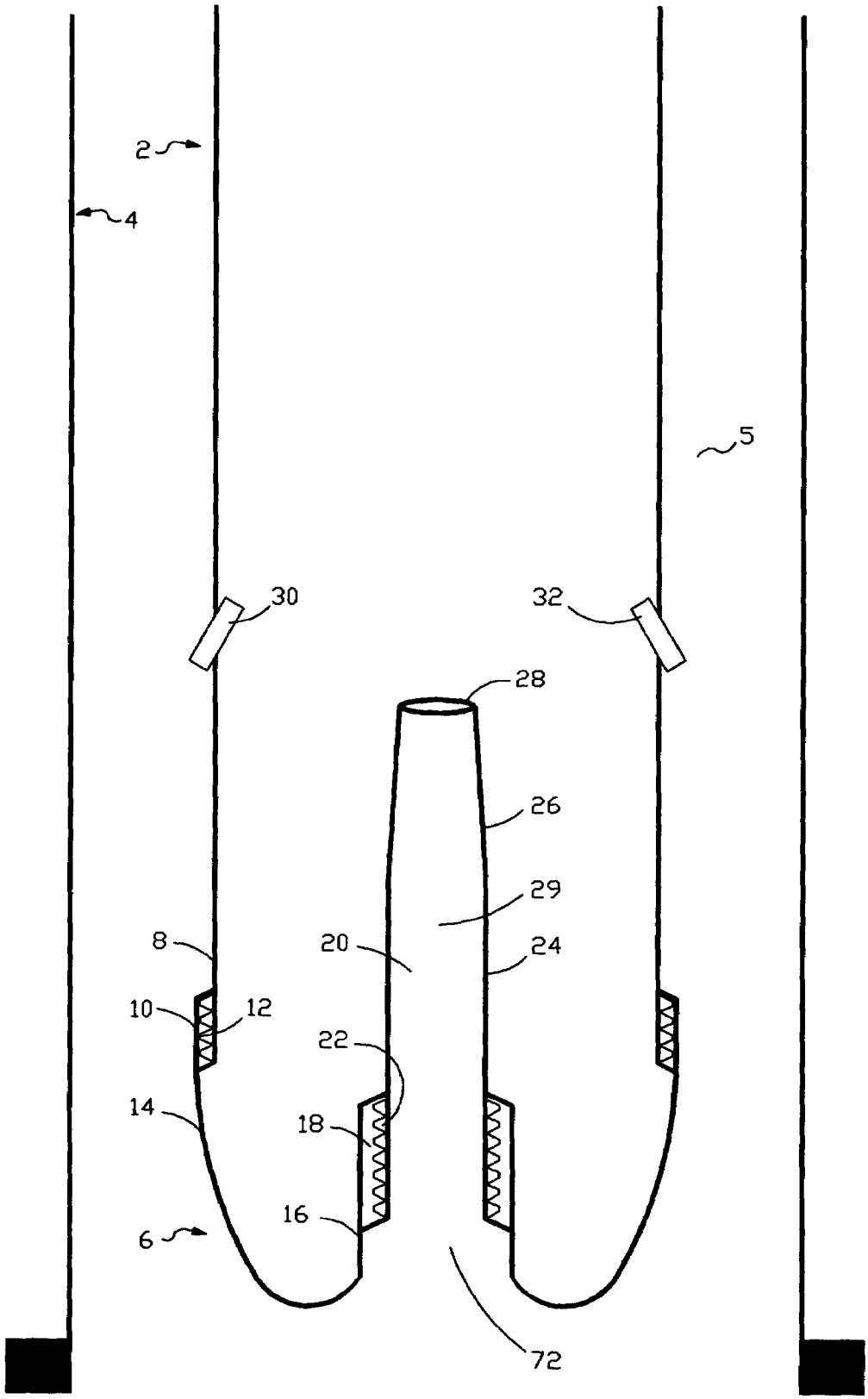
FIG. 1 depicts a first tubular member with suction member disposed within a wellbore.

Referring now to FIG. 1, a first tubular member 2 is shown concentrically disposed into a wellbore 4. As used herein, a wellbore can be a bore hole, casing string, or other tubular. In the most preferred embodiment, the wellbore 4 is a casing string. The first tubular member 2 has been lowered into the wellbore 4 using conventional means such as by coiled tubing, work string, drill string, etc. In one of the preferred embodiments, the wellbore extends below the surface and will intersect various types of subterranean reservoirs and/or mineral deposits. The wellbore is generally drilled using various types of drilling and/or boring devices, as readily understood by those of ordinary skill in the art.

The first tubular member 2 disposed within the wellbore 4 creates a wellbore annulus 5. The wellbore 4 may be a casing string cemented into place or may simply be a drilled bore hole. It should be noted that while a vertical well is shown in the figures, the wellbore 4 may also be of deviated, directional or horizontal contour.

The first tubular member 2 will have an annular nozzle that comprises an annular adapter and a suction tube. More specifically, the annular adapter 6 is attached to the second end 8 of the first tubular member 2. In the preferred embodiment, the annular adapter 6 contains thread means 10 that make-up with the thread means 12 of the first tubular member 2. The annular adapter 6 has a generally cylindrical outer surface 14 that has a generally reducing outer surface portion which in turn extends radially inward to inner portion 16. The inner portion 16 has thread means 18. The suction tube 20 will extend from the annular adapter 6. More specifically, the suction tube 20 will have thread means 22 that will cooperate with the thread means 18 in one preferred embodiment and as shown in FIG. 1. The suction tube 20 has a generally cylindrical surface 24 that then extends to a conical surface 26, which in turn terminates at the orifice 28. The orifice 28 can be sized for the pressure draw down desired by the operator at that point. The suction tube has an inner portion 29. Note that FIG. 1 shows the opening 72 of the annular adapter 6.

FIG. 1 further depicts a plurality of jets. More specifically, the jet 30 and jet 32 are diposed through the first tubular member 2. The jets 30, 32 are positioned so to direct a stream into the wellbore annulus 5. The jets are of nozzle like construction and are positioned in opposite flow directions, at different angles, and it is also possible to place the jets in different areas on member 2 in order to aid in stirring the fluid and solids within the wellbore annulus. Jets are usually sized small in order to take minimal flow from the micro annulus (as described below).

Figure 2:
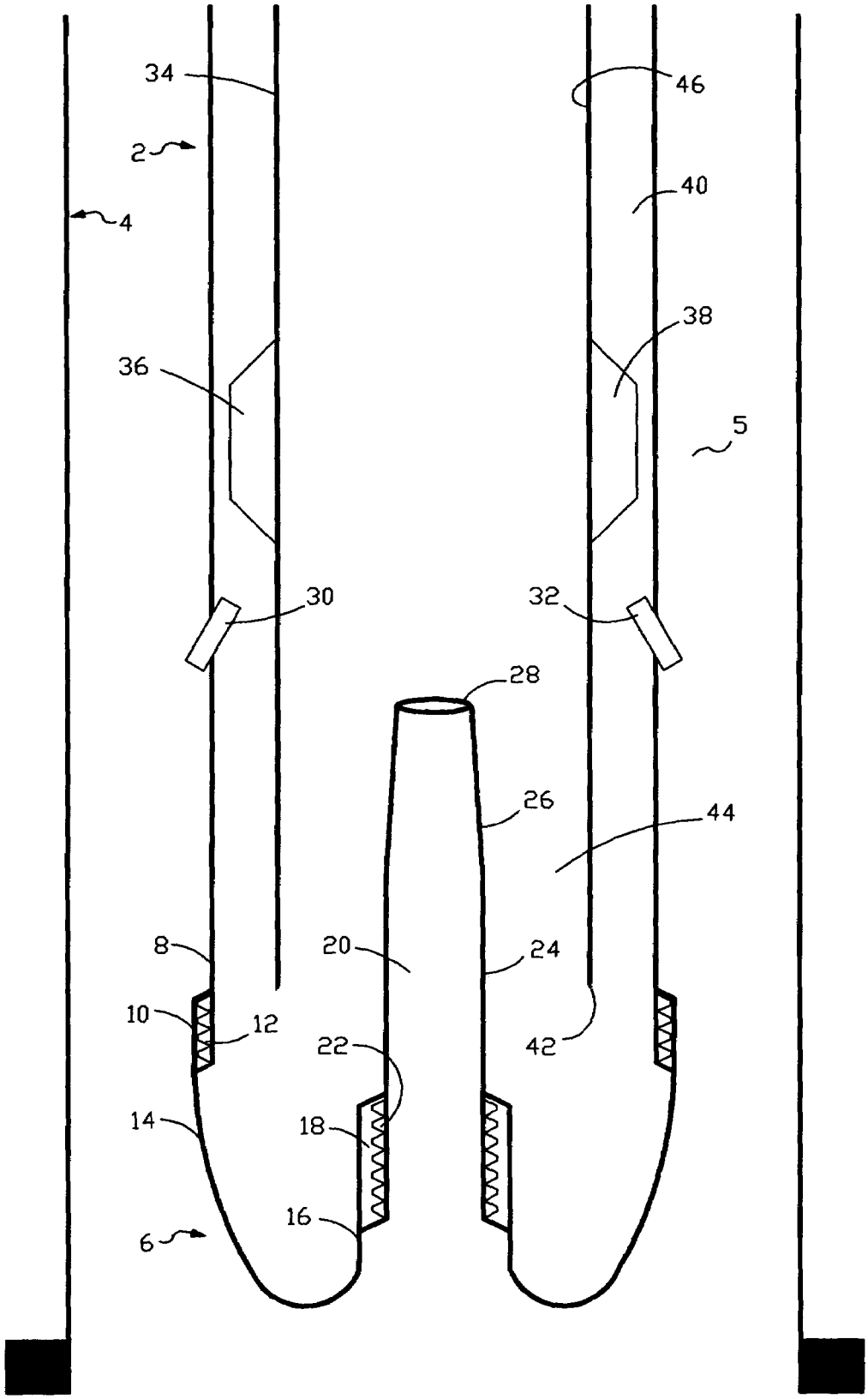
FIG. 2 depicts a second tubular member having been concentrically disposed within the first tubular member of FIG. 1.

Referring now to FIG. 2, a second tubular member 34 is shown having been concentrically disposed within the first tubular member 2 of FIG. 1. It should be noted that like numbers appearing in the various figures refer to like components. Thus, the second tubular member 34 has been concentrically lowered into the inner portion of the first tubular member 2 via conventional means, such as by coiled tubing, work string, drill string, etc. The second tubular member 34 will have stabilizer means 36 and 36. The stabilizer means 36, 38 may be attached to the outer portion of the second tubular member 34 by conventional means such as by welding, threads, etc. The stabilizer means may be a separate module within the second tubular member 34. In one embodiment, three stabilizer means are disposed about the outer portion of the second tubular member 34. As shown in FIG. 2, the stabilizer means are attached to the second tubular member 34. Additionally, the stabilizer means 36, 38 can be placed on the second tubular member 34 at any position, direction and/or angle needed to stabilize second tubular member 34 over suction tube 20.

Once the second tubular member 34 is concentrically positioned within the first tubular member 2, a micro annulus 40 is formed. The second tubular member 34 is placed so that the suction tube 20 extends past an end 42 of the second tubular member 34. As will be discussed in further detail later in the application, a medium is injected into the micro annulus 40, and wherein the medium will be directed about the end 42 into the passage 44 and up into the inner diameter portion 46 of the second tubular member 34. Note that the passage 44 is formed from the suction tube being disposed within the second tubular member 34. The passage 44 represents an annular flow area of the annular nozzle that the medium traverses through.

Figure 3:
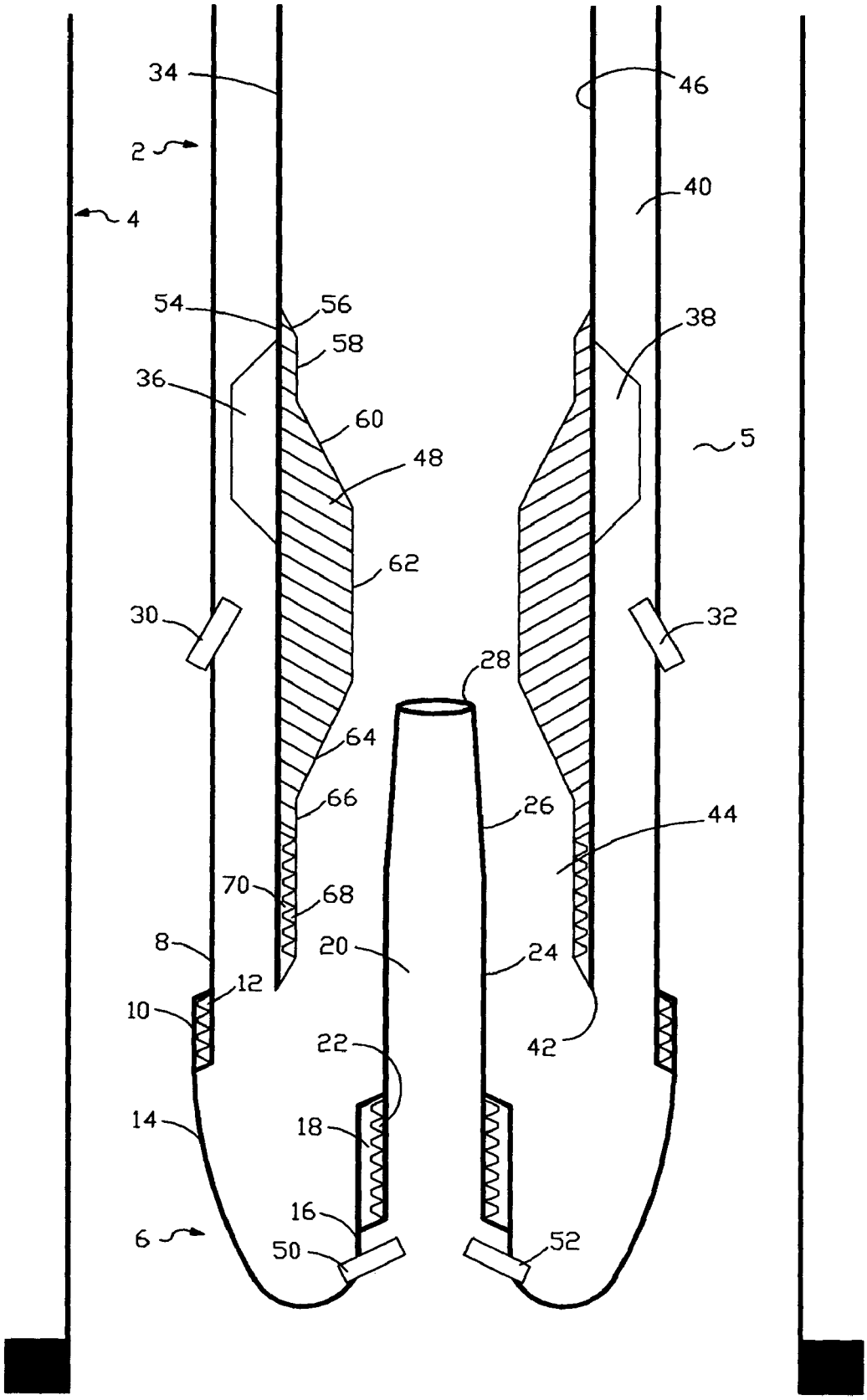
FIG. 3 depicts a second embodiment of the apparatus illustrated in FIG. 2.

Referring now to FIG. 3, a second embodiment of the apparatus illustrated in FIG. 2 will now be described. More specifically, an inner tubing restriction sleeve 48 has been added to the inner portion 46 of the second tubular member 34. FIG. 3 also shows two additional jets, namely jet 50 and jet 52. The jets are of nozzle like construction. The jets may be placed in varying positions and/or angle orientation in order to lift the wellbore fluids and solids to the surface. The position and/or angle orientation of the jets is dependent on specific wellbore configurations, flow characteristics, and other design characteristics. The jets 50, 52 are positioned to direct a portion of the micro annulus injection medium exiting the jets 50, 52 into the bottom of the suction tube 20.

The inner tubing restriction sleeve 48 has an outer diameter portion 54 that will cooperate with the inner diameter portion 46 of the second tubular member 34. Extending radially inward, the sleeve 48 has a first chamfered surface 56 that extends to an inner surface 58 which in turn extends to conical surface 60. The conical surface 60 then stretches to radial surface 62 which in turn extends to the conical surface 64 which then stretches to the radial surface 66. FIG. 3 further depicts thread means 68 on the restriction sleeve 48 that will cooperate with thread means 70 on the second tubular member 34 for connection of the restriction sleeve 48 to the second tubular member 34. Other means for connecting are possible, such as by welding, or simply by making the restriction sleeve integral with the second tubular member 34. It should be noted that the inner diameter portion of the restriction sleeve 48 can vary in size according to the various needs of a specific application. In other words, the inner diameter of the restriction sleeve 48 can be sized based on the individual well needs such as downhole pressure, fluid density, solids content, etc. In FIG. 3, the passage 44 is formed between the restriction sleeve 48 and the suction tube 20.

Figure 4:
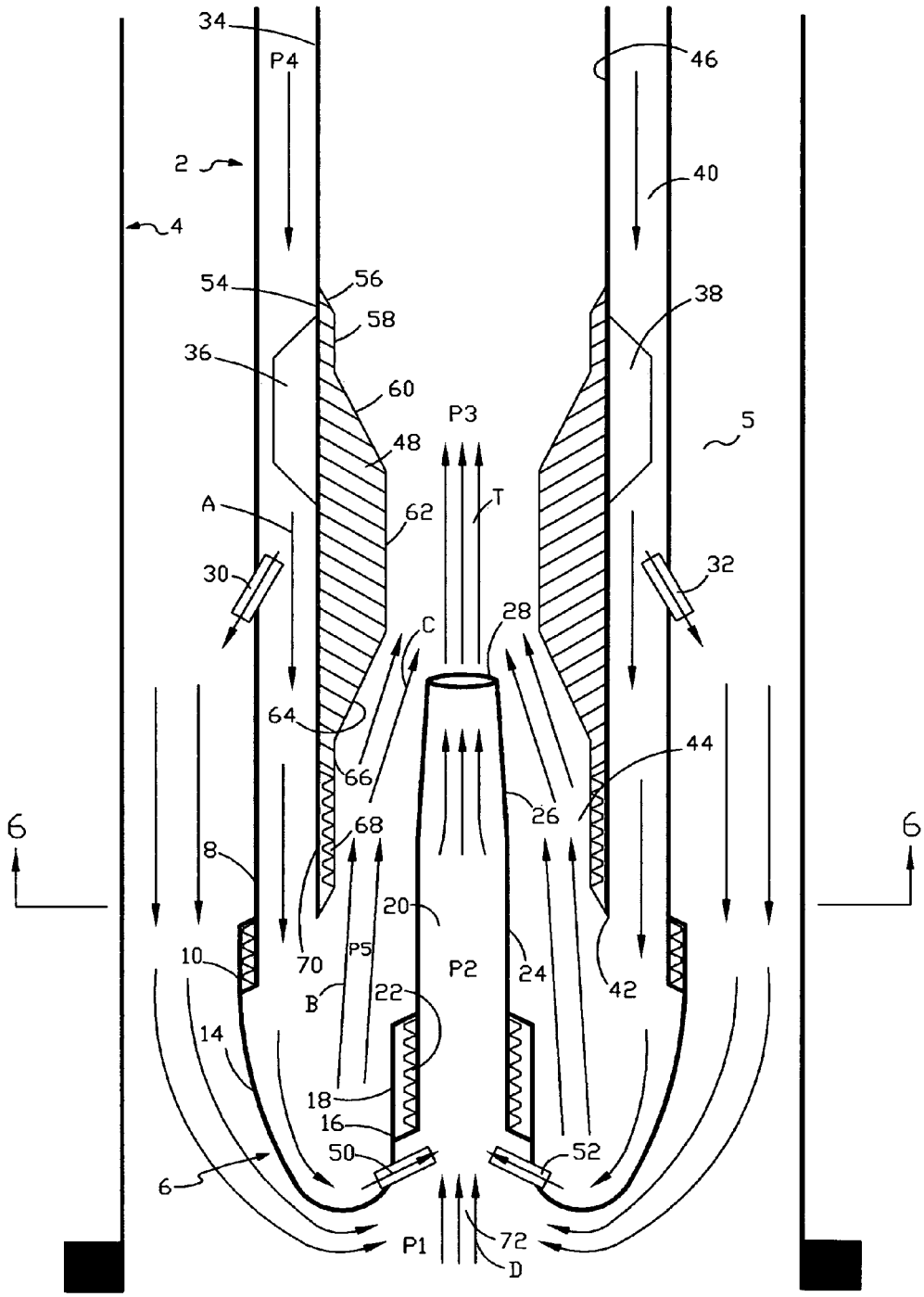
FIG. 4 depicts the embodiment illustrated in FIG. 3 with flow lines to depict the flow pattern within the wellbore.

Reference is now made to FIG. 4, and wherein FIG. 4 depicts the embodiment illustrated in FIG. 3 with flow lines to depict the flow pattern within the wellbore 4. The operator would inject a medium, such as gas, air, or fluid, into the micro annulus 40. The medium will generally be injected from the surface. The medium, sometimes referred to as a power fluid, proceeds down the micro annulus 40 (as seen by the arrow labeled "A") and into the annular nozzle. More specifically, the medium will flow around the end 42 and in turn into the passage 44 (see arrow "B"). Due to the suction tube 20 as well as the restriction sleeve 48, the flow area for the injected medium has been decreased. This restriction in flow area will in turn cause an increase in the velocity of the medium within the passage 44. As the medium continues, a further restriction is experienced once the medium flows past the conical surface 64 (see arrow "C"), and accordingly, the velocity again increases. The velocities within the passage 44 and immediately above the orifice 28 would have also increased. The pressure within the suction tube 20, however, will be experiencing a suction due to the venturi effect. The pressure P1 is greater than the pressure at P2 which causes flow into, and out of, the suction tube 20. As noted earlier, the orifice 28 and/or restriction sleeve 48 can be sized to create the desired pressure draw down. Hence, the fluid and solids contained within the wellbore annulus 5 will be suctioned into the suction tube 20 via opening 72. The suction thus created will be strong enough to suction fluids and solids contained within the well bore annulus 5 (see arrow "D"). Once the fluid and solids exit the orifice 28, the fluid and solids will mix and become entrained with the medium within the throat area denoted by the letter "T" and will be carried to the surface.

The jets 30, 32 will also take a portion of the medium injected into the micro annulus 40 and direct the medium into the wellbore annulus 5. This will aid in mixing and moving the fluid and solids within the wellbore annulus 5 into the suction tube 20. FIG. 4 also depicts the jets 50, 52 that will direct the medium that has been injected into the micro annulus into the suction tube 20. Again, this will aid in stirring the annular fluid and solids, and causing a suction at the opening 72 and aid in directing the fluid and/or solids into the suction tube 20.

According to the teachings of this invention, it is also possible to place a check valve (not shown) within the suction tube 20. The check valve would prevent the fluid and solids from falling back down. Also, it is possible to make the restriction sleeve 48 retrievable so that the restriction sleeve 48 could be replaced due to the need for a more appropriate size, wear, and/or general maintenance. Moreover, the invention may include placement of an auger type of device (not shown) which would be operatively associated with the annular adapter 6. The auger means would revolve in response to the circulation of the medium which in turn would mix and crush the solids.

Figure 5:
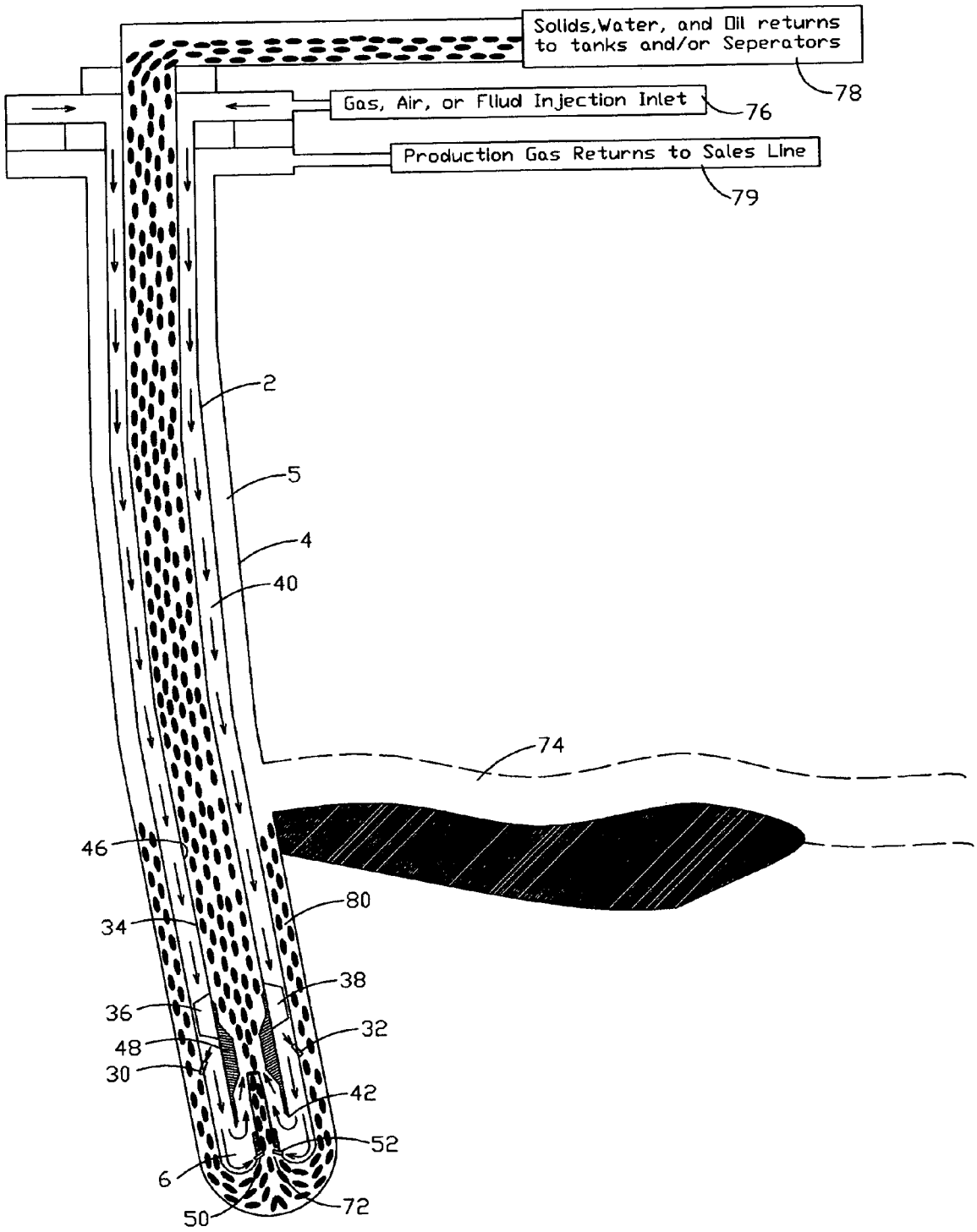
FIG. 5 is a schematic illustration of the apparatus of the present invention in use in a wellbore.

Referring now to FIG. 5, a schematic illustration of one of the preferred embodiments of the apparatus of the present invention in use in a wellbore will now be described. More specifically, the wellbore 4 intersects a natural gas deposit. In FIG. 5, the natural gas deposit is a coal bed methane seam. In the case of a coal bed methane seam, and as those of ordinary skill will recognize, a bore hole 74 is drilled extending from the wellbore 4. As shown in FIG. 5, the bore hole 74 is essentially horizontal, and the bore hole 74 may be referred to as a drainage bore hole 74. The methane gas embedded within the coal bed methane seam will migrate, first, to the drilled bore hole 74 and then, secondly, into the wellbore 4. It should be noted that the invention is applicable to other embodiments. For instance, the natural gas deposit may be a subterranean hydrocarbon reservoir. In the case where the natural gas deposit is a subterranean hydrocarbon reservoir, there is no requirement to drill a drainage bore hole. The in-situ hydrocarbons will flow into the wellbore annulus 5 due to the permeability of the reservoir. Hence, the invention herein described can be used in coal bed methane seams as well as traditional oil and gas subterranean reservoirs.

The annular adapter 6 is shown attached to the first tubular member 2. The suction tube 20 extends into the second tubular member 34 and inner tubing restriction sleeve 48 as previously noted. The medium is injected from the surface from a generator means 76. The medium is forced (directed) down the wellbore 4. As noted earlier, the medium flowing through the annular nozzle will in turn cause a suction within the opening 72 so that the fluid and solids that have entered into the wellbore 4 can be withdrawn.

The fluid and solids that enter into the inner portion 46 of the second tubular member 34 will be delivered to separator means 78 on the surface for separation and retention. As the fluid is drawn down to a sufficient level within the wellbore 4, gas can migrate from the natural gas deposit into the wellbore 4. The gas can then be produced to the surface to production facility means 79 for storage, transportation, sale, etc.

As seen in FIG. 5, the wellbore 4 contains a sump area 80. Thus, in one embodiment, the sump area 80 can collect the fluid and solids which in turn will be suctioned from the wellbore 4 with the novel apparatus herein disclosed. The fluid level is drawn down thereby allowing the gas from the deposit to enter into the wellbore 4 for production to the surface. If the subterranean mineral deposit is pressure deficient or is subject to water encroachment, then water may migrate back into the wellbore, and into the sump. The water level can rise within the wellbore 4, thereby reducing or shutting-off gas production. Once the water rises to a sufficient level so that gas production is interrupted, then, and according to the teachings of the present invention, the fluid level can be drawn down using the suction method and apparatus herein disclosed, and production can be restored. This can be repeated indefinitely or until the subterranean mineral deposit is depleted.

It should also be noted that it is possible to also inject the injection medium down the wellbore annulus 5. Hence, the operator could inject into both the micro annulus 40 and wellbore annulus 5, or either, depending on conditions and desired down hole effects.

Figure 6:
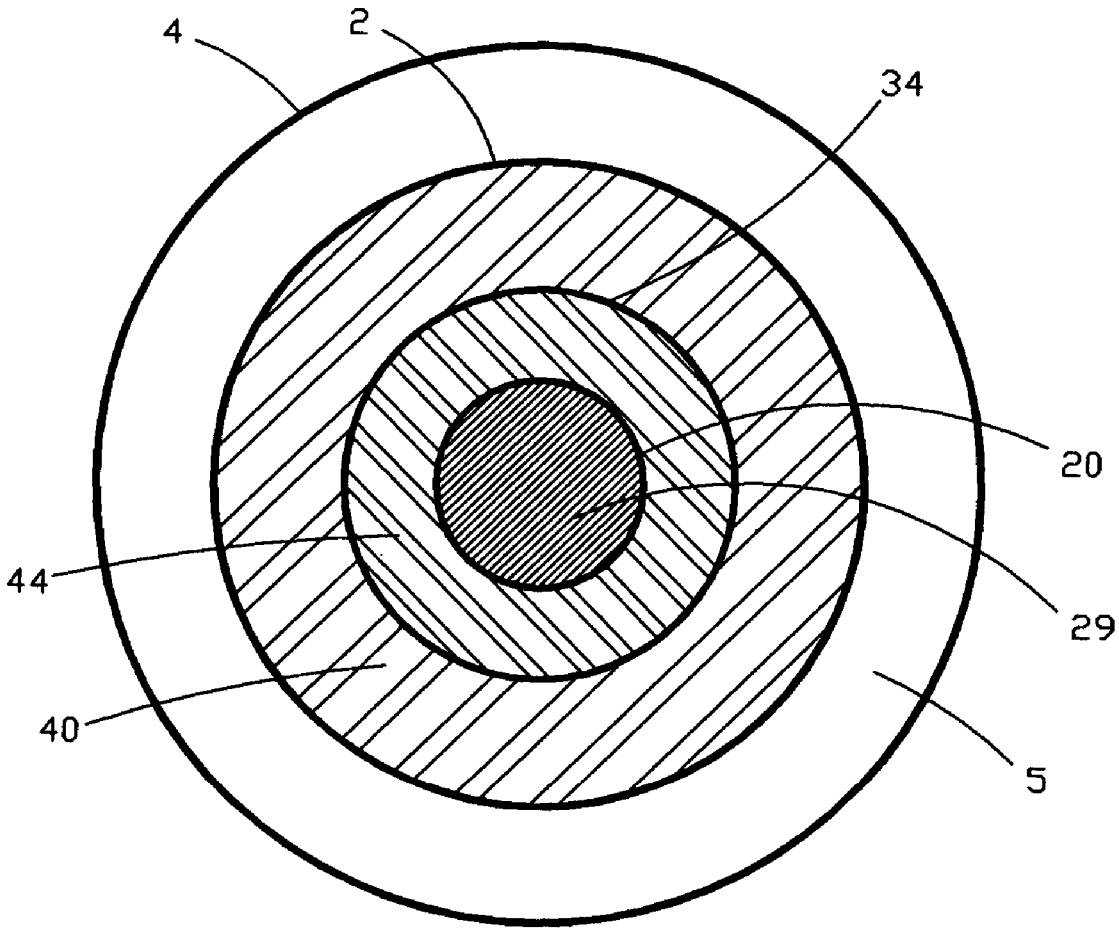
FIG. 6 is a cross sectional view of the apparatus taken from line 6—6 of FIG. 4.

FIG. 6 is a cross sectional view of the apparatus taken from line 6—6 of FIG. 4. In the view of FIG. 6, the wellbore annulus 5 is shown. The micro annulus 40 is shown, and as previously described, the medium (power fluid) is injected down the micro annulus. The FIG. 6 also shows the passage 44, which is formed due to the configuration of the annular nozzle, and wherein the passage 44 represents an annular flow area for passage of the power fluid. The suction tube's inner portion is seen at 29 and wherein the fluid and solids being suctioned into the suction tube's inner portion 29 is being drawn from the wellbore annulus 5.

As understood by those of ordinary skill in the art, a stream that exits a restriction will have considerable kinetic energy associated therewith, and wherein the kinetic energy results from a pressure drop generated by the restriction. Generally, the sizing of the restriction determines the pressure drop, and a desired pressure drop can be caused by varying the size of passage 44. This can be accomplished by varying the diameter of the restriction sleeve which reduces flow area, increase velocity and in turn effects a pressure drop. As noted earlier, a portion of FIG. 6 depicts the flow area created due to placement of the restriction sleeve 48. Hence, if the restriction sleeve's 48 inner diameter portion is enlarged, then the effective area of the passage 44 would be reduced thereby increasing the pressure drop. By the same token, the size of the suction tube 20 walls could be enlarged, thereby reducing the effective flow area which in turn would cause an increase pressure drop.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a review thereof.

I claim:

1. An apparatus for suctioning fluids and solids from a wellbore, the apparatus comprising:

a first tubing member disposed within the wellbore so that a wellbore annulus is formed therein, the first tubing member having a suction tube device at a first end, and wherein said suction tube device extends into an inner portion of said first tubing member and wherein said suction tube device contains an inner portion and an outer portion and wherein said inner portion has an unobstructed circular flow area;

a second tubing member concentrically disposed within said first tubing member so that a micro annulus is formed therein for injection of a power fluid, and wherein a first end of said second tubing member is concentrically positioned about said outer portion of said suction tube device so that an annular passage for the power fluid is formed relative to an inner portion of said second tubing member and the outer portion of said suction tube, and wherein said inner portion of said suction tube forms a passage for the fluid and solids within said wellbore annulus.

2. The apparatus of claim 1 further comprising stabilizer means, disposed about said second tubing member, for stabilizing said second tubing member within said first tubing member.

3. The apparatus of claim 2 further comprising jet means, disposed within said first tubing member, for delivering an injected medium from said micro annulus into the wellbore annulus.

4. The apparatus of claim 3 further comprising:

means, disposed at the surface, for injecting the injection medium into said micro annulus.

5. The apparatus of claim 4 further comprising an inner tubing restriction sleeve disposed within said second tubing member and wherein said suction tube device extends into said inner tubing restriction sleeve.

6. The apparatus of claim 5 wherein said injection medium is selected from the group consisting of gas, air, or fluid.

7. The apparatus of claim 5 wherein said wellbore intersects and extends past a coal bed methane gas seam so that a sump portion of the wellbore is formed.

8. The apparatus of claim 7 wherein the apparatus is placed at a position below the coal bed methane gas seam.

9. An apparatus for lifting fluids and solids within a wellbore, wherein said wellbore intersects a natural gas deposit having natural gas and wherein said wellbore intersects and extends past the natural gas deposit so that a sump portion of the well bore is formed, the apparatus comprising:

a first tubular disposed within the wellbore so that a wellbore annulus is formed therein, and wherein said first tubular has a distal end and a proximal end and wherein said wellbore annulus has a fluid level therein;

an annular nozzle operatively attached to the distal end of said first tubular, and wherein said annular nozzle comprises: an annular adapter; and, a suction tube that extends from said annular adapter into an inner portion of said first tubular, wherein said suction tube has an inner portion and an outer portion;

a second tubular concentrically disposed within said first tubular so that a micro annulus is formed therein for injection of a power fluid, and wherein a first end of said second tubular is concentrically positioned about said outer portion of said suction tube so that an annular passage for the power fluid is formed within an inner portion of said second tubular;

wherein said inner portion of said suction tube has an open end in communication with said sump portion, said open end having an unobstructual circular cross-sectional area to lift the fluids and solids located in said well bore annulus and wherein said wellbore annulus is in communication with a gas production line for producing gas from the natural gas deposit once the fluid level within said wellbore annulus is drawn down.

10. The apparatus of claim 9 further comprising jet means, disposed within said first tubular, for delivering an injected medium from the micro annulus into the wellbore annulus.

11. The apparatus of claim 10 further comprising:

stabilizer means, disposed about said second tubular, for stabilizing said second tubular within said first tubular, inner restriction sleeve disposed within the inner portion of the second tubular, and wherein said inner restriction sleeve receives said suction tube.

12. The apparatus of claim 11 further comprising:

means, located at the surface, for injecting the injection medium into said micro annulus.

13. The apparatus of claim 11 wherein said suction tube is threadedly attached to said annular adapter.

14. The apparatus of claim 11 wherein said injection medium is selected from the group consisting of gas, air, or fluid.

15. The apparatus of claim 11 wherein said wellbore intersects and extends past a coal bed methane gas seam so that a sump portion of the wellbore is formed.

16. The apparatus of claim 15 wherein the apparatus is placed below the coal bed methane gas seam in said sump area.

17. A method of drawing down a fluid column and solids in a wellbore, and wherein said wellbore intersects a natural gas deposit having natural gas, the method comprising:

providing a first tubular within the wellbore so that a wellbore annulus is formed therein, the first tubing member having an annular nozzle at a first end, and wherein said annular nozzle contains an annular adapter that is connected to a cylindrical suction tube, and wherein said cylindrical suction tube having an inner portion and an outer portion and wherein said inner portion has an unobstructed circular cross-sectional area, and wherein said suction tube extends into an inner portion of said first tubular;

lowering a second tubular concentrically within said first tubular so that a micro annulus is formed, and wherein a first end of said second tubular is concentrically positioned about said outer portion of said suction tube so that an annular passage if formed;

injecting a medium into the micro annulus;

channeling the medium through said annular passage nozzle;

increasing the velocity of the medium within said annular passage;

causing an area of low pressure within the unobstructed circular cross-sectional area of the inner portion of said suction tube;

drawing down the fluid contained within the wellbore annulus into the unobstructed circular cross-sectional area of the inner portion of said suction tube;

suctioning the solids contained within the well bore annulus into the unobstructed circular cross-sectional area of the inner portion of said suction tube;

exiting the fluid and solids from the inner portion of said suction tube into an inner portion of the second tubular;

mixing the fluid and solids with the medium in the inner portion of the second tubular;

discharging the fluid and solids and medium at the surface, drawing down the level of the fluid within the wellbore annulus;

flowing the natural gas from the natural gas deposit into the wellbore annulus once the fluid level reaches a predetermined level;

producing the natural gas in the wellbore annulus to a surface collection facility.

18. The method of claim 17 further comprising:

injecting the medium into the wellbore annulus;

mixing the medium with the fluid within the wellbore annulus;

forcing the medium and fluid into the suction tube.

19. The method of claim 17 further comprising:

jetting the medium from the micro annulus into the wellbore annulus;

mixing the medium with the fluid and solids within the wellbore annulus;

forcing the medium and fluid into the suction tube.

20. The method of claim 19 wherein the wellbore contains a sump area below the level of the natural gas deposit and wherein said suction member is positioned within the sump area.

21. The method of claim 20 wherein the natural gas deposit is a coal bed methane seam.

22. A device for suctioning fluids and solids from a wellbore, the device comprising:

a first tubing member disposed within the wellbore so that a wellbore annulus is formed therein, the first tubing member having an annular nozzle at a first end, and wherein said annular nozzle extends into an inner portion of said first tubing member, and wherein said annular nozzle includes a cylindrical suction tube that has an inner portion that is in communication with said wellbore annulus, and wherein said inner portion has an unrestricted cross-sectional area;

a second tubing member concentrically disposed within said first tubing member so that a micro annulus is formed for injection of a power fluid therein, and wherein a first end of said second tubing member is concentrically positioned about said suction tube so that an annular flow area for the injected power fluid is formed between an outer portion of said suction tube and an inner portion of said second tubing member, and wherein said annular flow area is in communication with said micro annulus;

jet means, disposed within said first tubing member, for delivering an injected medium from said micro annulus into the wellbore annulus.

23. The device of claim 22 further comprising an inner tubing restriction sleeve disposed within said second tubing member and wherein said annular nozzle extends into said inner tubing restriction sleeve.

* * * * *